US008854215B1

(12) United States Patent
Ellis

(10) Patent No.: US 8,854,215 B1
(45) Date of Patent: Oct. 7, 2014

(54) AUTOMATED PET DOOR

(71) Applicant: Brian Ellis, Seattle, WA (US)

(72) Inventor: Brian Ellis, Seattle, WA (US)

( * ) Notice: Subject to any disclaimer, the term of this patent is extended or adjusted under 35 U.S.C. 154(b) by 0 days.

(21) Appl. No.: 14/213,667

(22) Filed: Mar. 14, 2014

Related U.S. Application Data

(60) Provisional application No. 61/790,932, filed on Mar. 15, 2013.

(51) Int. Cl.
*G08B 23/00* (2006.01)

(52) U.S. Cl.
USPC ..... 340/573.3; 340/573.1

(58) Field of Classification Search
USPC ..... 340/573.3, 573.1, 539.13; 119/721, 72
See application file for complete search history.

(56) References Cited

U.S. PATENT DOCUMENTS

| | | | |
|---|---|---|---|
| 4,497,133 | A | 2/1985 | Blenkinsop |
| 5,177,900 | A | 1/1993 | Solowiej |
| 6,141,911 | A | 11/2000 | Reid |
| 6,297,739 | B1 | 10/2001 | Small |
| 6,944,990 | B2 | 9/2005 | Noyes |
| 6,966,147 | B2 | 11/2005 | Solowiej |
| 7,382,328 | B2 | 6/2008 | Lee, IV et al. |
| 7,564,362 | B2 | 7/2009 | Cole et al. |
| 7,656,291 | B2 | 2/2010 | Rochelle et al. |
| 7,765,955 | B2 | 8/2010 | Brooks et al. |
| 7,798,103 | B2 | 9/2010 | Bosserdet, Jr. et al. |
| 8,240,085 | B2 | 8/2012 | Hill |
| 8,281,749 | B2 | 10/2012 | Dukes |
| 8,312,844 | B2 | 11/2012 | Mann |
| 8,430,064 | B2 | 4/2013 | Groh et al. |
| 8,434,264 | B2 * | 5/2013 | Bosserdet, Jr. ..... 49/169 |
| 8,436,735 | B2 | 5/2013 | Mainini |
| 8,438,999 | B2 | 5/2013 | Hardi et al. |
| 8,456,296 | B2 | 6/2013 | Piltonen et al. |
| 2004/0100386 | A1 | 5/2004 | Tendler |
| 2005/0274463 | A1 | 12/2005 | Becker |
| 2005/0284402 | A1 | 12/2005 | Becker |
| 2007/0234643 | A1 | 10/2007 | Siegal et al. |
| 2008/0156274 | A1 | 7/2008 | Andrade et al. |
| 2008/0278335 | A1 | 11/2008 | Welte |
| 2010/0116219 | A1 | 5/2010 | Noyes |
| 2010/0126071 | A1 | 5/2010 | Hill |
| 2010/0147226 | A1 | 6/2010 | Tsengas |
| 2011/0061605 | A1 | 3/2011 | Hardi et al. |

(Continued)

FOREIGN PATENT DOCUMENTS

| | | | |
|---|---|---|---|
| EP | 1975365 | A1 | 10/2008 |

*Primary Examiner* — Shirley Lu
(74) *Attorney, Agent, or Firm* — R. Reams Goodloe, Jr.

(57) ABSTRACT

An automated pet door system. The system provides a user programmable database and system engine for controlling the passage of selected animals through a portal, such as a door, or screen, or other passage limiting device. The system is permissionable, in that the user may provide a set of dates, times, events, or other instructions, through a user input device to establish a then current operating envelope for each of one or more selected animals. A unique identification tag, which may use active radio frequency identification tag techniques, provides identity information for each candidate animal. Multiple sensor inputs, providing information such as door position, proximity of animals to the door, and direction and velocity of animals, are provided as inputs to a decision engine, which evaluates sensor inputs over time, before determining whether to open or close the pet door.

30 Claims, 5 Drawing Sheets

(56) References Cited

U.S. PATENT DOCUMENTS

| | | | |
|---|---|---|---|
| 2012/0067290 | A1 | 3/2012 | Mainini |
| 2012/0182145 | A1 | 7/2012 | Jameson et al. |
| 2012/0272696 | A1 | 11/2012 | Hill |
| 2013/0092099 | A1 | 4/2013 | Hardi et al. |
| 2013/0099922 | A1 | 4/2013 | Lohbihler |
| 2013/0174618 | A1 | 7/2013 | Brooks et al. |
| 2013/0192526 | A1 | 8/2013 | Mainini |
| 2013/0207803 | A1 | 8/2013 | Charych |

* cited by examiner

AUTOMATED PET DOOR

RELATED PATENT APPLICATIONS

This invention claims priority from U.S. Provisional Patent Application Ser. No. 61/790,932 filed on Mar. 15, 2013, entitled AUTOMATED PET DOOR, the disclosure of which is incorporated herein in its entirety, including the specification, drawing, and claims, by this reference.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This application relates to systems for control of passage through portals to structures, and more particularly, to novel methods and systems for the movement of pets to and from secure enclosures, such as building structures.

BACKGROUND

In recent years, the computerized management of access to and from buildings has become routine in industry and government. However, many of the systems utilized for such applications require that a user execute or pass a security step of one sort or another, such as card presentation to a card reader, password entry, or thumb print or retina scan, or the like. However, the requirements of many of such systems are not practically transferable for use with pets. Yet, with increasingly valuable contents in homes or other building structures, and with increasingly aggressive methods attempted by thieves to gain access to such valuable contents, it would be advantageous if a highly pet specific yet highly secure system were to become available for use, especially for home owners concerned about the potential security risks inherent in prior art pet entry systems. Consequently, there have been various attempts to develop security devices and methods for implementation of the same, for controlling passage of pets though doors into and out of secure areas such as homes, apartments, or other structures. However, there remains a need for an improved system for controlling access by pet through a portal to a building structure, and to such a system that further includes controls that minimize or virtually eliminate the possibility that a human intruder might gain access to the structure through such portal, particularly as may be applied to high value custom homes. Further, it would be advantageous if such a product made minding a pet more convenient, and routine access procedures required a minimum amount of time for intervention. And, it would be even more convenient if such a product enabled remote access to the system, for changing permissions as regards pet access to a structure.

SUMMARY

A novel system that provides a user programmable database controlling the passage of selected animals through a portal, such as a door, or screen, or other passage limiting device, has been developed. In various embodiments, the system may be considered permissionable, in that the user may provide a set of dates, times, events, or other instructions, to a user input device to set access instructions for one or more selected animals. In an embodiment, an access structure such as a pet door in a home defines a portal through which one or more selected animals may pass. In an embodiment, the access structure, such as the just mentioned pet door, may have one or more field limiting elements—such as a moveable door—that may be placed (a) in an open condition wherein selected animals may pass through the portal, or (b) in a closed condition wherein selected animals cannot pass through the portal. In various embodiments, an identification tag for candidate animals is provided. In an embodiment, such identification tag may provide unique identity information for a candidate animal. In various embodiments, multiple candidate animals may have identification tags assigned in the system, such as multiple dogs at a selected location, or a dog and a cat at a particular location.

In an embodiment, the novel system includes a programmable database that establishes operating envelope definitions. The operating envelope definitions include user programmable settings that a user may set up for one or more individually selected animals, or for a group of animals, generally. In various embodiments, a plurality of sensors S in a series of sensors $S_1$ through $S_N$, where N is a positive integer, are provided. In an embodiment, the sensors S provide an output signal at a sensor blink rate, to produce, from various sensor, time indexed output data. The system includes a system engine that may be established by programming on a general purpose computer or by other methods as will be known to those of skill in the art. The system engine (a) acquires data from the identification tag(s), (b) acquires the time indexed output data from the sensors S, and (c) compares the time indexed output data from the sensors S with the then current programmed operating envelope definitions. The system engine then determines whether or not the time indexed output data from each of the sensors S is (1) acceptable and is promoted to an action indicator state result, or (2) is unacceptable and is demoted to an inaction indicator state result. Such evaluation is determined over a predetermined plurality of times, to compile an aggregate measurement result of the sensor data, to (i) determine whether the data just evaluated provides an action indicator state result, or whether the sensor data just evaluated is determined to provide an inaction indicator state result. Based on the aggregate measurement of results, the system engine decides whether or not to classify a candidate animal as a selected animal for passage through the portal. If a candidate animal is determined to be a selected animal, then the system engine instructs the one or more field limiting elements to be placed in an open condition to allow passage of a selected animal therethrough. In an embodiment, the system engine directs a motor controller to energize a door motor, which opens (or closes) the portal.

BRIEF DESCRIPTION OF THE DRAWING

Various aspects of the developments described herein will be described by way of exemplary embodiments, illustrated in the accompanying drawing figures in which like reference numerals denote like elements, and in which.

The foregoing figures, being merely exemplary, contain various elements that may be present or omitted from actual apparatus that may be constructed to provide different embodiments for a system for controlling access to portals in building structures, or to various configurations for components thereof, or to methods for operation thereof. An attempt has been made to draw the figures in a way that illustrates at least those elements that are significant for an understanding of the components of an embodiment for a useful system for controlling access of animals to structures. However, various other components, or elements in components for such systems, or for assembly and use of the same, may be utilized in order to provide an automated pet door and automated programmable control system, according to the concepts disclosed herein.

DETAILED DESCRIPTION

Figure 5:
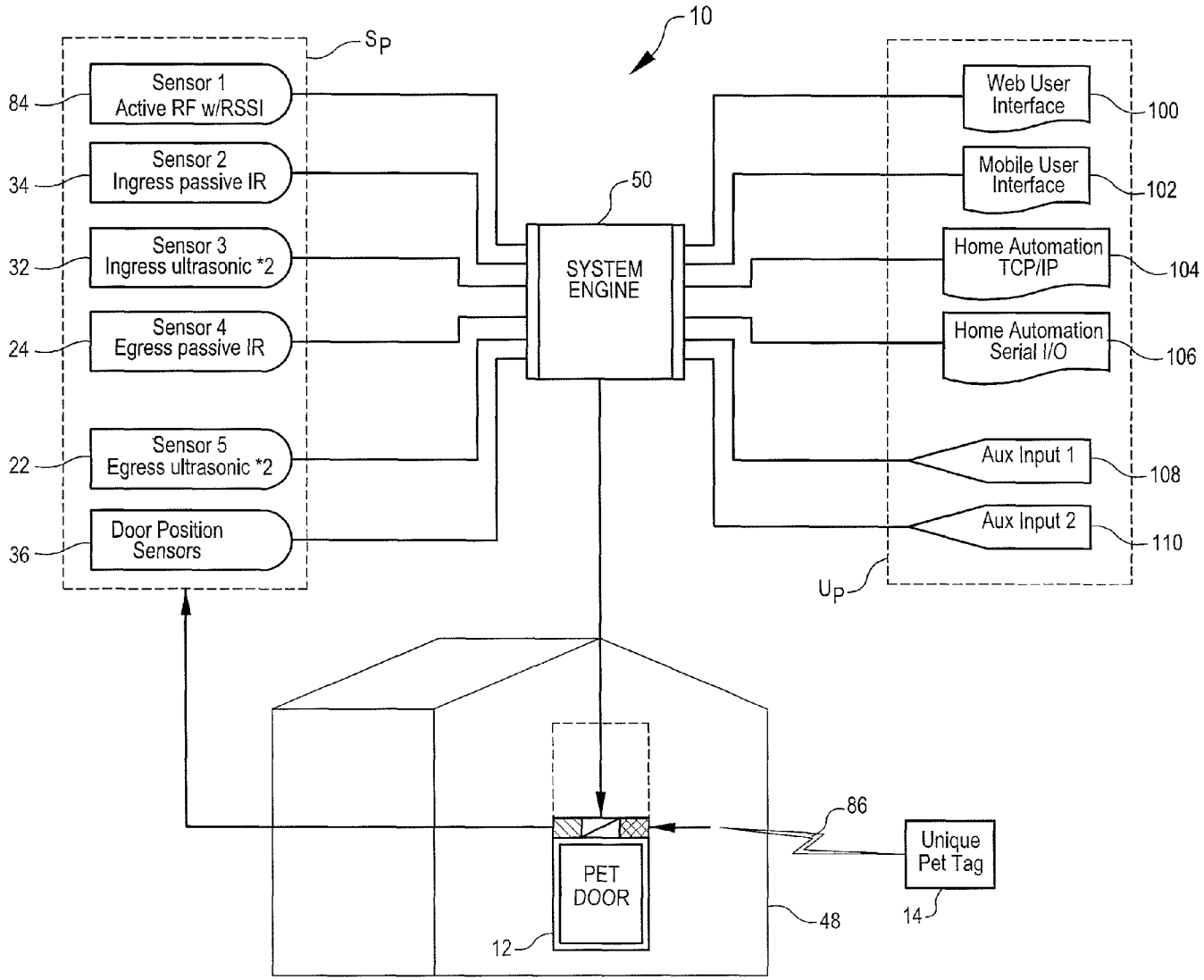
FIG. 5 provides a schematic illustration of the various elements of the system described herein, including a unique pet tag, which in an embodiment may use an active radio frequency identification device, a pet door in a building structure, the door having a door motor for opening and closing the door, a set of sensors, a system engine, and a set of user input/output devices and/or systems.

Attention is directed to FIG. 5, which provides a schematic illustration of the various elements of a system 10 that provides for the automation of a pet door 12. Components of the system 10 include use of a unique pet tag 14, which in an embodiment may be a radio frequency identification tag. In an embodiment, such radio frequency identification (RFID) tag may be an active RFID tag, which provides reporting capability, not just response to interrogation capability, as would be the case with a passive RFID tag. In any event, the pet door 12 defines a portal 16, with clear space open portal dimensions as further noted by reference arrows 17 seen in FIGS. 1 and 2, through which one or more animals 18 may pass. In an embodiment, as shown in FIGS. 1 and 2, the portal 16 may be rectangular in shape.

Figure 1:
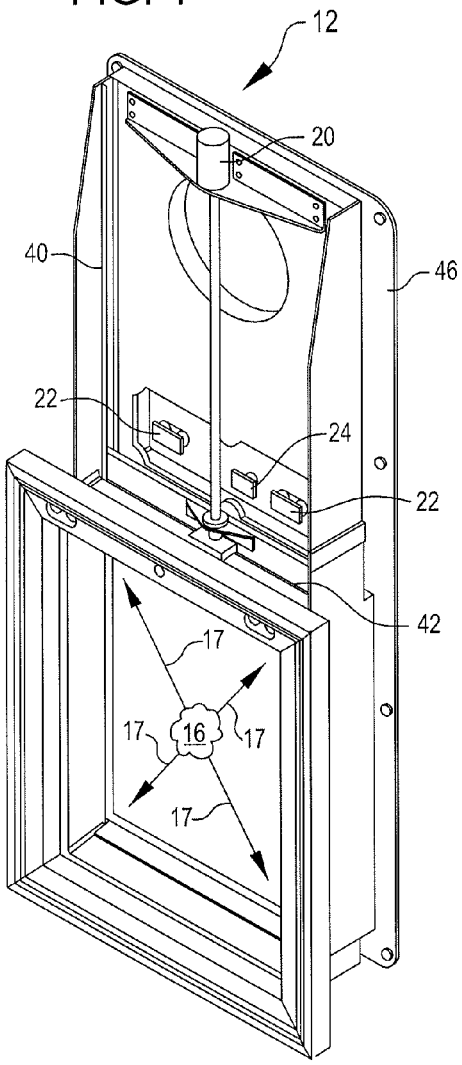
FIG. 1 provides a perspective view of the front (obverse side) of a pet door which may be used for portal operation according to the developments described herein, and in the embodiment illustrated, includes a frame for mounting the door in a building structure such as a house, a door which moves up and down in the frame, a motor for moving the door up and down, and, as illustrated mounts with sensors thereon, such as ultrasonic egress sensors, and passive infrared egress sensors.
Figure 2:
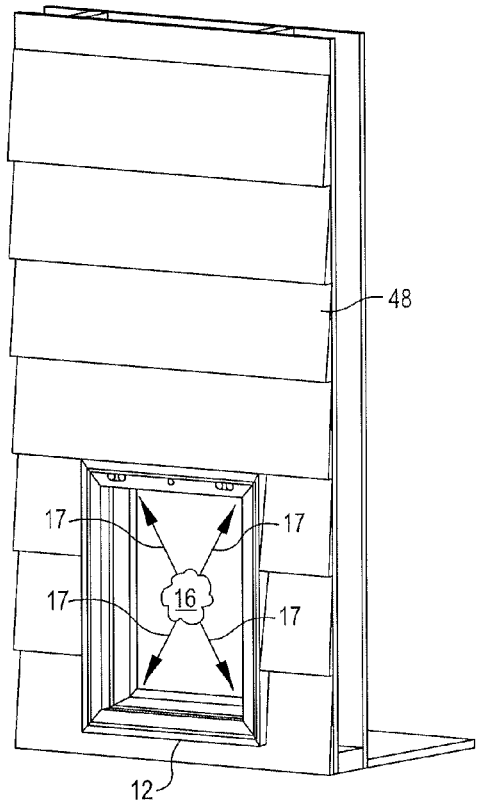
FIG. 2 provides a front, outside perspective view of a pet door as just illustrated in FIG. 1, now mounted in a building structure such as a house, showing how the door may be framed and cosmetically finished to provide a visually appealing pet door.

As seen in FIGS. 1 and 5, in embodiment, the door 12 is provided with door motor 20 for opening and closing the door 12. Door 12 may be placed in an open position, and remain open, or may temporarily open, and then close after a delay, based on either timing or input from sensors, or both. The door 12 may remain closed based on timing, or input from sensors, or both. Returning to FIG. 5, in an embodiment, at least one sensor S is provided at or near door 12. In an embodiment, a plurality of sensors S are provided. For example, in door 12 shown in FIG. 1, two ultrasonic egress sensors 22 are provided, which sensors 22 are designated as Sensor Number 5 in FIG. 5. FIG. 5 uses a "*2" designation to indicate that two sensors 22 are provided. Also provided in door 12 in FIG. 1 is a passive infrared egress sensor 24, which sensor is designated as Sensor Number 4 in FIG. 5.

Figure 3:
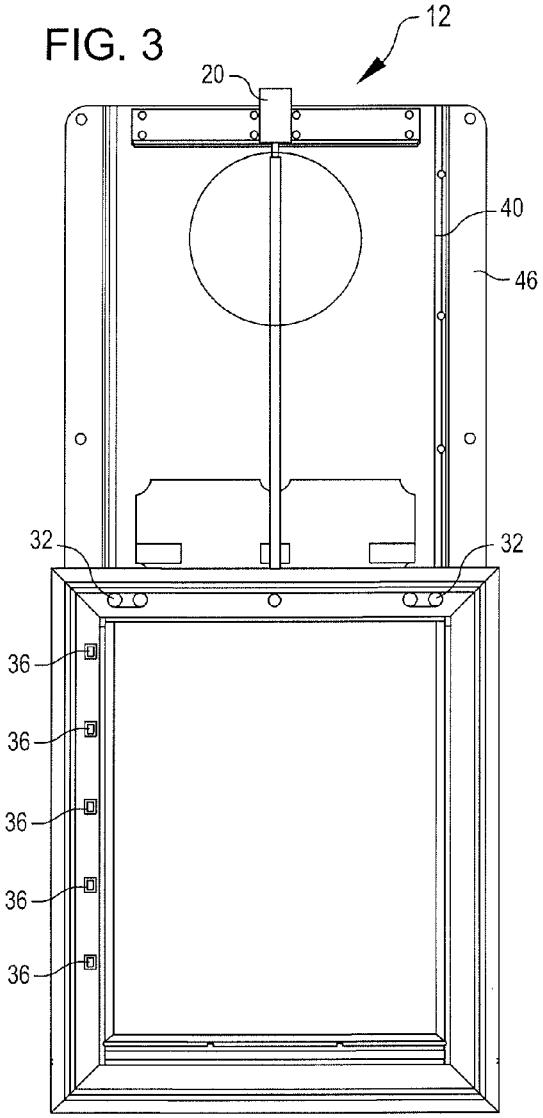
FIG. 3 provides a rear (reverse side) elevation view of the pet door just illustrated in FIGS. 1 and 2 above, and which may be used for portal operation according to the developments described herein, and which is shown including a frame for mounting the door in a building structure such as a house, a door which moves up and down in the frame, a motor for moving the door up and down, and, as illustrated mounts with sensors thereon, such as ultrasonic ingress sensors, passive infrared ingress sensors, and door position sensors.

As seen FIGS. 3 and 5, in an embodiment at least one sensor S is provided at or near door 12. In an embodiment, a plurality of sensors S are provided. For example, in door 12 shown in FIG. 3, two ultrasonic ingress sensors 32 are provided, which sensors 32 are designated as Sensor Number 3 in FIG. 5. FIG. 5 uses a "*2" designation to indicate that two sensors 32 are provided. Also provided in door 12 in FIG. 3 is a passive infrared ingress sensor 34, which sensor is designated as Sensor Number 2 in FIG. 5. Further, a plurality of door position sensors 36 are provided; these door position sensors 36 provide information to the system engine as to the actual position of door 12 (or in other embodiments, the actual position of some other field limiting element, such as a screen or gate).

Figure 4:
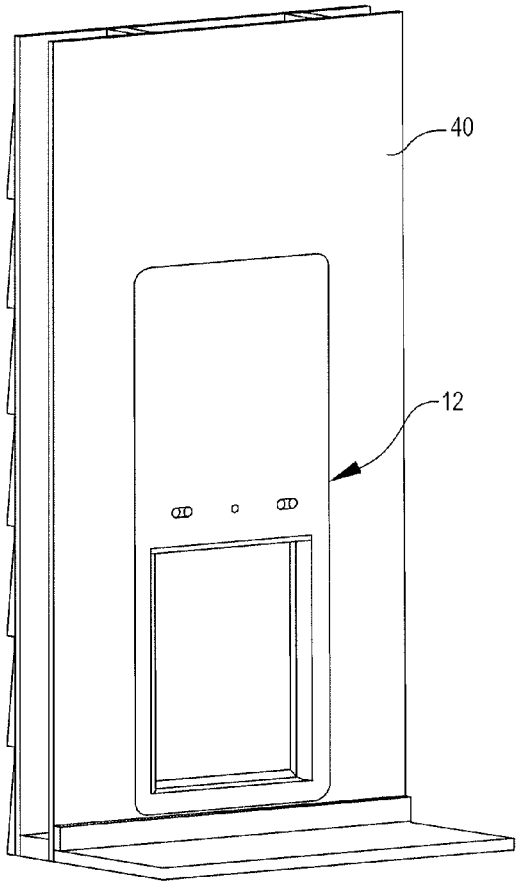
FIG. 4 provides a rear, or inside perspective view of a pet door as just illustrated in FIG. 2 above, shown mounted in a building structure such as a house, showing how the door may be framed and cosmetically finished to provide a visually appealing pet door.

FIG. 1 also shows that door 12 includes a frame 46 which includes a slide 40 for securing a sliding field limiting element which, as depicted, may be a solid door element 42 that moves as energized by motor 20 in an upward direction to an open position O (see FIG. 4), or downward to a closed position C, as shown in FIG. 1. Frame 40 also includes a framing flange 46, for mounting the door 12 in a building structure 48 such as a house, as shown in FIGS. 2 and 4. The door 12 may be framed and cosmetically finished to provide visually appealing pet door 12 for ingress and egress of animal(s) 18.

Figure 6:
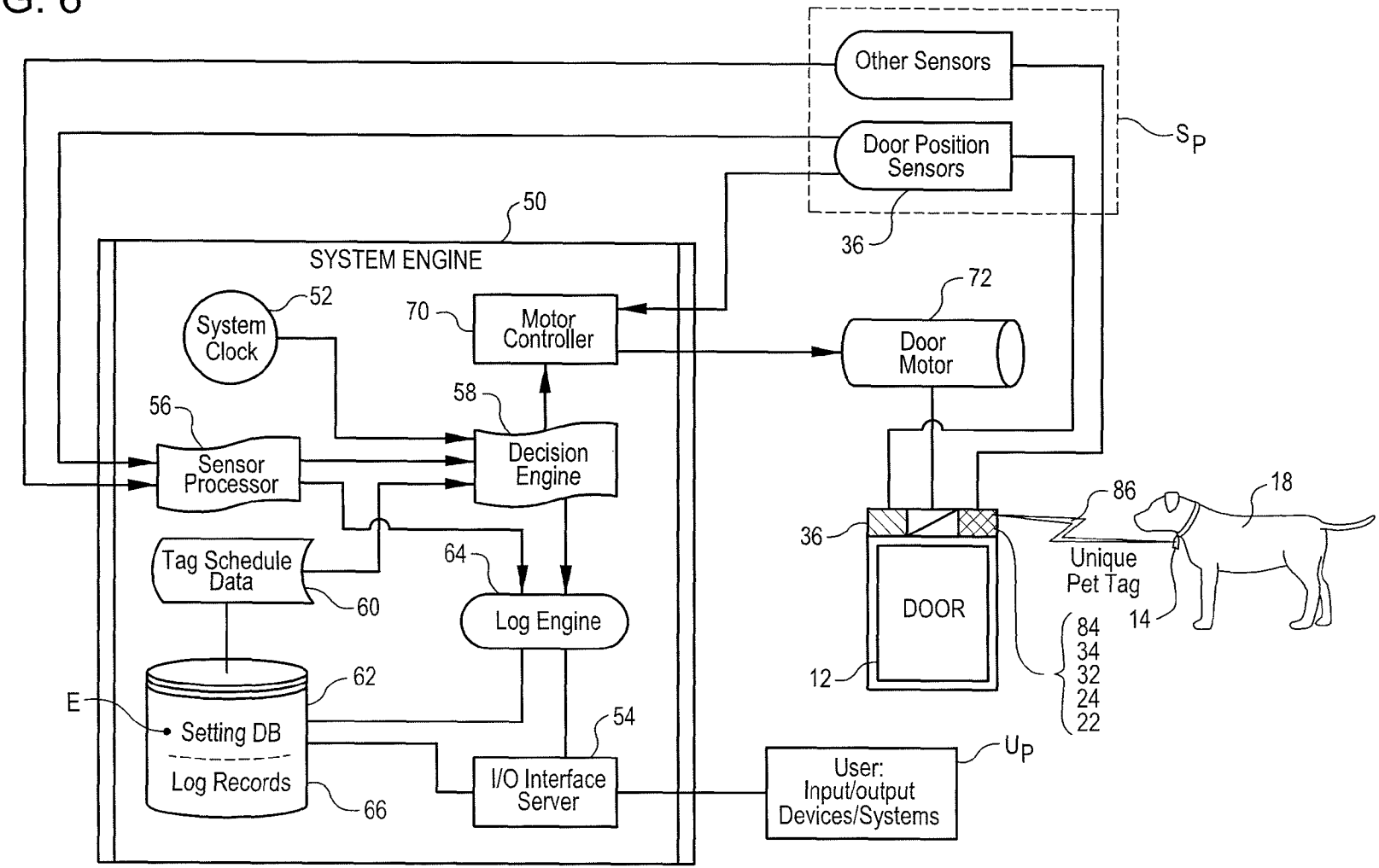
FIG. 6 provides a schematic illustration of the various elements of the system engine described herein, including a system clock, an input/output server, a sensor processor, a decision engine, a log engine, a database for storing user programmable tag schedule data, a database log to various record data, including sensor data, and a motor controller, for instructing a door motor to open and close.

Attention is directed to FIG. 6, where a schematic illustration of an embodiment for an automated pet door system 10 is provided, showing the various elements of a system engine 50, and some inputs and outputs to the system engine 50. In an embodiment, the system engine may include a clock 52 for establishing time of data acquisition from one or more sensors S in a sensor S package $S_P$. An input/output interface server 54 receives input from, and provides output to, one or more user interface devices or systems that may be utilized in a user interface package $U_P$. A sensor processor 56 receives data from one or more sensors in a selected sensor package $S_P$. Data from sensor processor 56 is directed to a decision engine 58, which in an embodiment, may evaluate data along a series of times T, such as T=0, T=1, T=2, etc, as further explained below in the discussion of logic shown in FIG. 7, in order to provide a robust, fault tolerant decision engine 58. In an embodiment, the decision engine 58 may check a user programmable tag schedule data 60, to investigate then current settings with regard to a unique pet tag 14, as well as to check other settings in a settings database 62 (some of which settings may be user programmable, and some of which settings may be factory preset—with or without user override capability), as may be selected in various embodiments. In an embodiment, sensor inputs from sensor package $S_P$ may be provided by sensor processor 56 to a log engine 64, and selected inputs may be logged in a record log 66.

As also shown in FIG. 6, near door 12, radio signal strength sensors 84 may be provided to receive radio communications 86 from pet tag 14. Also, door position sensors 36 may provide data on the position of door 42 Besides the motor 72 and other physical aspects of the door 12, such sensors and logic-based components are important components of system 10.

Based on logic in the decision engine 58, which logic may be user programmable in various embodiments, the decision engine 58 in the system engine 50 determines whether or not to move the pet door 12 to an open position O, or to keep the pet door 12 in a closed position C. Thus, based on a combination of tag schedule data 60, the data in settings database 62, and input from the sensor package $S_P$, the automated pet door 12 is controlled.

Figure 7:
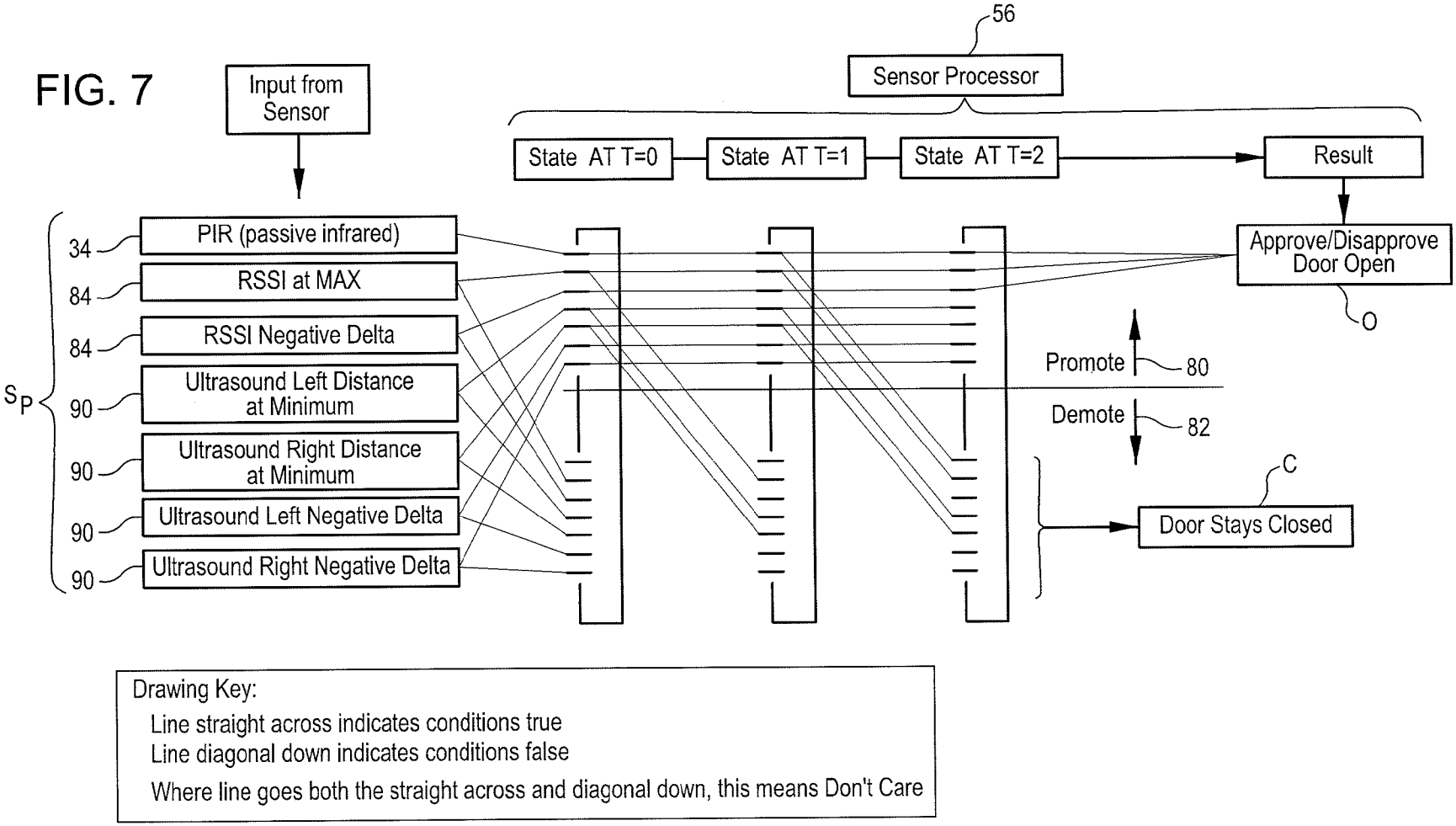
FIG. 7 provides a schematic illustration of an embodiment for robust decision logic as described herein, wherein input from a plurality of sensors is evaluated at a plurality of times, and based on evaluation of inputs during a selected set of discrete times, inputs are graded and promoted or demoted as to validity of the input, and then the decision engine in the system engine determines whether or not to open the pet door, or to keep the pet door in a closed position.

Turning now to FIG. 7, a schematic illustration for an embodiment for robust sensor processor 56 logic is provided. Data from the sensor package $S_P$ is provided from at least one, and in many embodiments, from a plurality of sensors S. Such data is evaluated at a plurality of times T, in a sequence of times from T=0, T=1, T=2, to T=N, where N is a selected number of sample times. Based on evaluation of inputs during a selected set of discrete times T, inputs are graded by the sensor processor 56, and the input is promoted (see promote arrow 80) or demoted (see demote arrow 82), based on the determination by the sensor processor 56 as to validity of a particular input from the sensor package $S_P$. As an example the promotion or demotion of data "for" or "against" door opening is sent to the decision engine 58, where if resulting from "door open" promotion received from the sensor processor 56, the decision engine 58 checks the data base to determine whether or not an animal 18 is authorized at that time to enter or leave the structure thru portal 16. For example, a passive infrared ingress sensor 34 may provide a signal when sensing that an animal 18 is near a door 12. Similarly, a radio signal strength sensor (RSSI) 84 may provide a "MAX" indication, i.e. that of maximum signal strength of the signal 86 from the pet tag 14, and thus, indicating that animal 18 is near the sensor. Alternately, the RSSI sensor 84 may provide a reading which indicates decreasing signal strength over a series of times T, which indicates that the animal 18 is moving away from sensor 84, and thus away from door 12. An ultrasound sensor 90 may be provided, which may include spacial data, such as whether an animal 18 is located to the left or to the right, and if so, how far, from the ultrasound sensor 90, and thus evaluate how far the animal 18 is from the door 12. Similarly, data from the ultrasound sensor 90, at various times T, may provide data with a negative change in distance, or with a positive change in distance from ultrasound sensor 90, and indicate that an animal 18 is increasingly closer to, or distant from, pet door 12. In the event the sensor processor 56 determines that a particular sensor S is inoperative, or is not providing valid data, then the failure may be logged, and reported to the I/O interface server 54, for reporting to user via a device or system in the user interface package $U_P$.

As also depicted in FIG. 5, a user interface package $U_P$ may include a variety of devices and or systems. For example, a user may access the system engine 50 via a web user interface 100. Or a user may utilize a mobile user interface 102, such as a mobile phone or other hand held device, such as an I-Pad or other tablet computing device. In an embodiment, the automated pet door system 10 may be coupled with a home automation system. A home automation system 104 may include TCP/IP communications with the system engine 50. Or, a home automation system 106 may include serial input/output to the system engine 50. And, provisions may be included for alternate additional or auxiliary inputs 108 and/or 110.

In summary, a system 10 for controlling passage of selected animals 18 through a portal 16 is provided. The system includes providing an access structure such as a pet door 12, that defines a portal 16 through which one or more selected animals 18 may pass. The access structure 12 includes one or more field limiting elements such as a solid door 42 that may be placed (a) in an open condition O wherein said selected animals 18 can pass through the portal 16, or (b) in a closed condition C wherein said selected animals 18 cannot pass through the portal. To use the system, an identification pet tag 14 for a candidate animal 18 is provided. The identification pet tag 14 provides identity information for the candidate animal 18. A programmable settings database 62 is provided, which database 62 includes operating envelope definitions E. The operating envelope definitions E include user programmable settings for selected animals 18. At least one sensor S, and in an embodiment, a plurality of sensors S in a series of sensors $S_1$ through $S_N$, where N is a positive integer, are provided in a sensor package $S_P$. Each of the selected sensors S provide an output signal at a sensor blink rate, to produce, from each sensor S, time indexed output data. A system engine 50 is provided. The system engine 50 (a) acquires data from the identification pet tag 14, (b) acquires the time indexed output data from selected sensors S, and (c) compares the time indexed output data from the sensors S with said operating envelope definitions E, and determines whether or not the time indexed output data from each of the S is (1) acceptable and thus is promoted to an action indicator state result—that is promoted toward a decision to move or keep a door in a door open O position—or (2) is unacceptable and is demoted to an inaction indicator state result—that is demoted toward a door closed position result. The decisions are evaluate over a predetermined plurality of times to determine an aggregate measurement result of (1) identification tag 14 data and (2) sensor S data, as regards data (i) determined to provide action indicator state results (e.g., valid data in the door open O direction), and (ii) determined to provide inaction indicator state results (e.g., invalid data, or data indicating a door closed C direction). Based on the aggregate measurement result, from the sensor processor 56, the decision engine 58 evaluates schedule data, authorizations for a particular animal 18, and other constraints, to determine whether or not to classify a candidate animal 18 as a selected animal for passage through the portal 16, and instructs the one or more field limiting elements such as solid door 42 to be placed in an open condition to allow passage of a selected animal 18 therethrough.

In various embodiments, the number of sensors S in a sensor package $S_P$ may include at least three sensors. In an embodiment, at least one of the sensors in said plurality of sensors S is a passive infrared sensor; such passive infrared sensor may be a passive infrared ingress sensor 34, or a passive infrared egress sensor 24. Further, in various embodiments, identification tags 14 may be provided as an active radio frequency identification tag. In various embodiments, an active radio frequency signal strength sensor 84 may be provided. In various embodiments, one or more ultrasonic ingress sensors 32 may be provided. In various embodiments, one or more ultrasonic egress sensors 22 may be provided. In various embodiments, the ultrasonic sensors 22 or 32 may provide distance measurement sensing capability. In an embodiment, at least one ultrasound sensor may be used as a boundary measurement sensor.

As illustrated in FIG. 7, the system 10 may include a sensor processor 56 that evaluates data from sensors S for a predetermined plurality of times, before the decision engine 58 determines whether and/or how to instruct the motor controller 70 to direct the door motor 72, in order to reposition or maintain the position, of one or more field limiting elements such as solid door 42. As shown in FIG. 7, the predetermined plurality of times sampled may be three times, or more. More generally, each "order" or instruction from the sensor processor 56 is related to multiple data samples from sensors S from different time intervals. In various embodiments, a number of sensor inputs are collected and evaluated at regular intervals. When the result of a first evaluation (at time T=0) satisfies a predetermined set of criteria, an estimation of when to issue a door open command is generated. If progressive conditions for opening the door are not met at subsequent sample times and evaluation intervals (T=1, T=2, etc.) the decision to open the door 42 is delayed or cancelled). Conversely, when progressive conditions are satisfied, then the command to open the door 42 is given. Such technique provides an Nth order approximation based on the number of sample times N, since the sensors S provide data regarding the state of the system 10, and describe such state over time. Since any description may not ever be completely accurate (e.g., a sensor may be inoperative, or providing inaccurate data), the logic for sensor processor 56 described herein provides an excellent numeric description which is at least a good approximation of the then current system state. Each new piece of data form sensors S adds to the "order" (description accuracy), making the approximation more accurate in terms of describing the state of system 10. Thus, the technique described herein is a beneficial advance in the state of the art in devices for regulating passage of animals into and out of structures.

In various embodiments for system 10, the identification tag 14 may include individually separate and distinct identification data for each candidate animal 18. In various embodiments for the use of system 10, each candidate animal may be assigned a separate and unique identification tag 14.

In various embodiments for system 10, a user interface server 54 may be provided. The I/O interface server 54 provides access the system engine 50 from one or more devices or systems in a user interface package $U_P$, so that the user may provide input of permissible settings to the tag schedule data 60, or to the settings database 62, to establish a then current operating envelope E set of data and instructions, as regards a particular identification tag 14. In various embodiments, separate operating envelops $E_1$, $E_2$, $E_3$, etc. may be established for each one of a set of individual identification tags $\mathbf{14}_1$, $\mathbf{14}_2$, $\mathbf{14}_3$, and so on, as may be worn by different animals $\mathbf{18}_1$, $\mathbf{18}_2$, and $\mathbf{18}_3$, respectively.

In various embodiments, the just described permissible settings may include one or more of (a) entry lockout time schedule, (b) exit lockout time schedule, (c) time delay period required before opening of the field limiting element(s) such as door 42, (d) an allowable time period for an opening of the field limiting element(s) such as door 42, and (e), any time delay period required before closing of the field limiting element(s) such as door 42. In various embodiments, the permissible settings may include one or more of (a) an identification tag 14 lockout, and/or (b), an identification tag 14 lock-in. Thus, a particular animal 18 (or a selected one in a plurality of animals as just noted above), may be prevented from leaving a building structure 48, or prevented from entering a building structure 48, according to a schedule programmed into the system engine 50 by a user. In various embodiments, the user interface package $U_P$ may provide access to the system engine 50 through an I/O interface server 54, for providing access to a user for input of direct commands. For example, a lockout reset capability, i.e. an override trigger mechanism, may be provided to a user, wherein a user may direct the system engine 50 to reset and ignore a prior lockout override instruction. In such event, the user may evaluate and select a further set of programmable override instructions. For example, a user may be provided with a selectable set of programmable override instructions including (a) a force door open instruction, and/or (b) a force door closed instruction. Or, in an embodiment, the auxiliary inputs 108 and 110 may provide access for external, customer-supplied sensors. For example a rain sensor could trigger an action in the door 42 to never let the door open for exit of animal 18 when a rain sensor S provides a door close instruction. Similarly, a simple "maid" wall switch could be provided, which could be turned on when the maid arrives, which may be programmed to not let an animal 18 pet inside the structure 48 when so instructed. Or, in an embodiment, a motion sensor or a camera sensor may provide data to the system engine 50.

In various embodiments, the system engine 50 may include computer memory sufficient to store at least one user accessible file. In an embodiment, such computer memory may be located in the interface server 54. In an embodiment, the interface server 54 may be configured to receive permissible setting data from a user. In an embodiment, the interface server 54 may be configured to receive input from one or more of (a) an in-home touch screen interface that may be provided by way of an auxiliary input 108 or 110, (b) a home automation computer 104 or 106, or (c) a mobile computing device 102.

In various embodiment, system 10 may be set up with a then current operating envelope E that includes definitions for one or more of (a) acceptable candidate animal 18 locations, (b) direction of movement of animal 18, and (c) velocity of animal 18. In an embodiment a candidate animal 18 may be prevented from passing through one or more field limiting elements such as door 42, if any one of location of animal 18, direction of movement of animal 18, or velocity of animal 18 falls outside of the then current operating envelope E for a particular animal 18.

In various embodiments, a system 10 may include sensors S that may provide a perimeter warning, such as by way of radio signal strength measurement, or ultrasound measurement, infrared beam technique, or other sensor device. In an embodiment, when the sensor processor 56 and or decision engine 58 determines that data constitutes an irregular or alarm condition, the field limiting elements such as door 42 may be set to a closed and remain closed condition. In various embodiments, sensors, such as radio signal strength indication sensor 84, may provide data sufficient for computation by the system engine 50 of the location of a candidate animal 18 having an identification tag 14. In an embodiment, the system 10 may include a plurality of sensors S with output data sufficient for computation by the system engine 50 of the velocity, and/or the direction of movement of a candidate animal 18 having an identification tag 14.

In the foregoing description, numerous details have been set forth in order to provide a thorough understanding of the disclosed exemplary embodiments for providing a system for providing automated pet doors, and permissionable, programmable instructions for such doors. However, certain of the described details may not be required in order to provide useful embodiments, or to practice selected or other disclosed embodiments. Further, the description may include, for descriptive purposes, various relative terms such as surface, adjacent, proximity, near, on, onto, and the like. Such usage should not be construed as limiting. Terms that are relative only to a point of reference are not meant to be interpreted as absolute limitations, but are instead included in the foregoing description to facilitate understanding of the various aspects of the disclosed embodiments. Various elements and components described for use in assembly of the system and for practice of the methods(s) described herein may have been described as multiple discrete items, in turn, in a manner that is most helpful in understanding such aspects and details. However, the order of description should not be construed as to imply that such items or sequence of operations are necessarily order dependent, or that it is imperative to fully complete one step before starting another. For example, the choice of how to configure a sensor, or where to mount a sensor, or how to define an operating envelope of acceptable traverse rates and/or traverse paths for a candidate animal, may be different as regards configuration and installation particulars amongst various animal types, or geographic locations, within the scope and coverage of the claims herein below. Further, different users may want the ability to program widely different operating envelopes for their animals, as compared to access schedules or event schedules that may be desired by other users. Further, certain details of an embodiment illustrated may not need to be provided, or performed in the precise or exact order of presentation herein. And, in different embodiments, one or more items may be performed simultaneously, or eliminated in part or in whole while other items may be added. Also, the reader will note that the phrase "an embodiment" has been used repeatedly. This phrase generally does not refer to the same embodiment; however, it may. Finally, the terms "comprising", "having" and "including" should be considered synonymous, unless the context dictates otherwise.

In view of the foregoing, it will be appreciated that the invention overcomes the long-standing need for a method and programmable system for setting permissions for passage of an animal through a portal. Further, the number and types of sensors also provide input for determining whether or not a particular animal should be allowed access through a portal such as a pet door. And, using unique identification tags, the system easily and correctly authenticates a candidate animal, before selecting such animal for passage through a portal such as a pet door. Various aspects and embodiments described and claimed herein may be modified from those shown without materially departing from the novel teachings and advantages provided by this invention, and may be embodied in other specific forms without departing from the spirit or essential characteristics thereof. Embodiments presented herein are to be considered in all respects as illustrative and not restrictive or limiting. This disclosure is intended to cover methods and apparatus described herein, and not only structural equivalents thereof, but also equivalent structures. Modifications and variations are possible in light of the above teachings. Therefore, the protection afforded to this invention should be limited only by the claims set forth herein, and the legal equivalents thereof.

The invention claimed is:

1. A system for controlling passage of selected animals through a portal, comprising:

providing an access structure defining a portal through which one or more selected animals may pass, said access structure comprising one or more field limiting elements that may be placed (a) in an open condition wherein said selected animals can pass through the portal, or (b) in a closed condition wherein said selected animals cannot pass through the portal;

providing an identification tag for a candidate animal, said identification tag providing identity information for said candidate animal;

providing a programmable database comprising operating envelope definitions, said operating envelope definitions including user programmable settings for selected animals;

providing a plurality of sensors S in a series of sensors $S_1$ through $S_N$, where N is a positive integer, each of said sensors S providing an output signal at a sensor blink rate, to produce, from each sensor, time indexed output data;

providing a system engine, said system engine (a) acquiring data from said identification tag, (b) acquiring said time indexed output data from said sensors S, (c) comparing said time indexed output data from said sensors S with said operating envelope definitions, and determining whether or not said time indexed output data from each of said sensors S is (1) acceptable and is promoted to an action indicator state result, or (2) is unacceptable and is demoted to an inaction indicator state result, (d) determining over a predetermined plurality of times an aggregate measurement result of (1) identification tag data and (2) sensor data (i) determined to provide action indicator state results, and (ii) determined to provide inaction indicator state results, and (e) deciding based on said aggregate measurement result, whether or not to classify a candidate animal as a selected animal, and to instruct said one or more field limiting elements to be placed in an open condition to allow passage of a selected animal therethrough.

2. The system as set forth in claim 1, wherein said plurality of sensors S comprises at least three sensors.

3. The system as set forth in claim 1, wherein at least one of said sensors in said plurality of sensors S comprises a passive infrared sensor.

4. The system as set forth in claim 1, wherein said identification tag comprises a radio frequency identification tag.

5. The system as set forth in claim 4, wherein said radio frequency identification tag comprises an active radio frequency identification tag.

6. The system as set forth in claim 1, wherein said plurality of sensors comprises a radio signal strength sensor.

7. The system as set forth in claim 1, wherein said plurality of sensors S comprises at least one ultrasound sensor.

8. The system as set forth in claim 7, wherein one of said at least one ultrasound sensor comprises a distance measurement sensor.

9. The system as set forth in claim 7, wherein one or said at least one ultrasound sensor comprises a boundary measurement sensor.

10. The system as set forth in claim 1, wherein said predetermined plurality of times comprises acquiring sensor data over at least three time intervals before deciding to instruct said one or more field limiting elements.

11. The system as set forth in claim 1, wherein said identity information comprises individually separate and distinct identification for each candidate animal.

12. The system as set forth in claim 11, wherein each candidate animal is assigned a separate and unique identification tag.

13. The system as set forth in claim 1, further comprising an interface server, said interface server providing access to a user for input of permissible settings.

14. The system as set forth in claim 13, wherein said permissible settings comprise one or more of (a) entry lockout time schedule, (b) exit lockout time schedule, (c) time delay period required before opening of said field limiting elements, (d) allowable time period for an opening of said field limiting elements, and, (e) time delay period required before closing of said field limiting elements.

15. The system as set forth in claim 13, wherein said permissible settings comprise one or more of (a) identification tag lockout, and (b) identification tag lock-in.

16. The system as set forth in claim 1, further comprising an interface server, said interface server providing access to a user for input of direct commands.

17. The system as set forth in claim 13, wherein at least one of said sensors comprises a perimeter warning sensor, said perimeter warning sensor comprising a lockout override capability, wherein said field limiting elements are set to a close and remain closed condition.

18. The system as set forth in claim 17, further comprising a lockout reset capability, wherein a user may direct said system engine to reset and ignore a lockout override instruction.

19. The system as set forth in claim 1, wherein said plurality of sensors provide output data sufficient for computation by said system engine of location of a candidate animal having an identification tag.

20. The system as set forth in claim 1, wherein said plurality of sensors provide output data sufficient for computation by said system engine of direction of movement of a candidate animal having an identification tag.

21. The system as set forth in claim 20, wherein said plurality of sensors provide output data sufficient for computation by said system engine of velocity of a candidate animal having an identification tag.

22. The system as set forth in claim 10, wherein said one or more field limiting elements comprises a door.

23. The system as set forth in claim 21, wherein said operating envelope comprises definitions for one or more of (a) acceptable candidate animal locations, (b) direction of movement, and (c) velocity.

24. The system as set forth in claim 23, wherein a candidate animal is prevented from passing through said one or more field limiting elements, if any one of location, direction of movement, or velocity falls outside of said operating envelope.

25. The system as set forth in claim 13, further comprising computer memory to store at least one user accessible file.

26. The system as set forth in claim 25, wherein the system engine is coupled to the computer memory, and wherein the interface is configured to receive permissible setting data from user.

27. The system of claim 26 wherein the interface is configured to receive input from one or more of (a) an in-home touch screen interface, (b) a home automation computer, or (c) a mobile computing device.

28. The system of claim 26, further comprising an override trigger mechanism, said override trigger mechanism comprising a further selectable set of programmable override instructions.

29. The system as set forth in claim 28, wherein said selectable set of programmable override instructions comprise (a) a force door open instruction, or (b) a force door closed instruction, or (c) an alternate schedule instruction.

30. A system for controlling passage of selected animals through a portal, comprising:

providing an access structure defining a portal through which one or more selected animals may pass, said access structure comprising one or more field limiting elements that may be placed (a) in an open condition wherein said selected animals can pass through the portal, or (b) in a closed condition wherein said selected animals cannot pass through the portal;

providing an identification tag for a candidate animal, said identification tag providing identity information for said candidate animal;

providing a programmable database comprising operating envelope definitions, said operating envelope definitions including user programmable settings for selected animals;

providing at least one sensor S, said sensor S providing an output signal at a sensor blink rate, to produce time indexed output data;

providing a system engine, said system engine (a) acquiring data from said identification tag, (b) acquiring said time indexed output data from said sensor S, (c) comparing said time indexed output data from said sensor S with said operating envelope definitions, and determining whether or not said time indexed output data from said sensor S is (1) acceptable and is promoted to an action indicator state result, or (2) is unacceptable and is demoted to an inaction indicator state result, (d) determining over a predetermined plurality of times an aggregate measurement result of (1) identification tag data and (2) sensor data (i) determined to provide action indicator state results, and (ii) determined to provide inaction indicator state results, and (e) deciding based on said aggregate measurement result, whether or not to classify a candidate animal as a selected animal, and to instruct said one or more field limiting elements to be placed in an open condition to allow passage of a selected animal therethrough.

* * * * *

UNITED STATES PATENT AND TRADEMARK OFFICE

CERTIFICATE OF CORRECTION

PATENT NO. : 8,854,215 B1
APPLICATION NO. : 14/213667
DATED : October 7, 2014
INVENTOR(S) : Brian Ellis It is certified that error appears in the above-identified patent and that said Letters Patent is hereby corrected as shown below:

IN THE SPECIFICATION:

Column 1, line 52, after the word "by", add --a--.

Column 5, line 12, after the words "position of door 42", add --.--.

Column 6, line 42, after the words "decisions are", delete "evaluate" and substitute therefore --evaluated--.

Signed and Sealed this
Twenty-eighth Day of April, 2015

Michelle K. Lee

Michelle K. Lee
*Director of the United States Patent and Trademark Office*